US005540363A

United States Patent [19]

Wilson

[11] Patent Number: 5,540,363

[45] Date of Patent: Jul. 30, 1996

[54] CONTAINER FOR TEMPORARILY HOLDING AND STORING A WET PAINTBRUSH

[76] Inventor: Ronald W. Wilson, 956 Garfield Ave., Salt Lake City, Utah 84105

[21] Appl. No.: 312,058

[22] Filed: Sep. 26, 1994

[51] Int. Cl.[6] ..... B65D 81/00

[52] U.S. Cl. ..... 224/148.7; 224/235; 224/240; 224/904; 224/666; 224/677; 224/679; 220/4.23; 220/736; 206/361; 206/15.3

[58] Field of Search ..... 224/148, 224, 224/226, 235, 236, 240, 241, 242, 252, 268, 269, 904; 220/4.23, 4.22, 736, 344; 206/1.7, 361, 15.2, 15.3

[56] References Cited

U.S. PATENT DOCUMENTS

| | | | |
|---|---|---|---|
| 2,654,504 | 10/1953 | Hyams | 220/736 |
| 3,127,985 | 4/1964 | Scott | 206/361 |
| 3,690,448 | 9/1972 | Switzer | 206/15.1 |
| 4,423,811 | 1/1984 | Knapp | 206/15.3 |
| 4,522,288 | 6/1985 | Wickman et al. | 190/900 |
| 4,746,042 | 5/1988 | King | 224/148 |
| 4,802,576 | 2/1989 | Kern | 206/361 |
| 4,890,731 | 1/1990 | Mroz | 220/4.22 |
| 4,951,857 | 8/1990 | Carr | 224/242 |

FOREIGN PATENT DOCUMENTS

| | | | |
|---|---|---|---|
| 1157554 | 7/1969 | United Kingdom | 206/361 |

*Primary Examiner*—Henry J. Recla
*Assistant Examiner*—Charles R. Eloshway
*Attorney, Agent, or Firm*—Terry M. Crellin

[57] ABSTRACT

A container for temporarily holding and storing a wet paintbrush will maintain the paintbrush in a useful condition for a limited period of time up to several days. The container has the shape of a hollow, substantially rectangular box. The container is formed from two shallow, rectangular members that are hingedly attached to each other along respective longitudinal edges of the rectangular members. The two shallow members open so as to allow positioning a paintbrush therein, and the shallow members can be closed upon each in clam shell fashion to close the container. An opening is provided in the top wall of the container to allow the handle of a paintbrush to extend from the container. Each shallow member has a layer of closed cell foam material positioned along the inside of the upper wall of the shallow member. The layers of closed cell foam material seal around the handle of a paintbrush when the shallow members move to their closed position with the handle of the paintbrush extending from the opening in the top wall of the container. A layer of open cell foam material is provided along the inside surface of the lower wall of each shallow member. The layers of open cell foam material absorb paint drippings from the paintbrush. The layers of open cell foam material can also contain a small amount of solvent for the paint.

7 Claims, 2 Drawing Sheets

CONTAINER FOR TEMPORARILY HOLDING AND STORING A WET PAINTBRUSH

BACKGROUND OF THE INVENTION

1. Field of the Invention

The present invention relates to containers for storing paint brushes, and in particular to containers for temporary storage of wet paintbrushes.

2. State of the Art

Containers for temporarily storing wet paintbrushes are known in the prior art. In U.S. Pat. No. 3,690,448 a closable plastic bag is provided. The entire paintbrush is inserted into the plastic bag, and the plastic bag is sealed. Because of the messy problem of inserting the wet paintbrush bristles into the plastic bag, the bristles are first wrapped in flexible plastic that is held on the bristles by a rubber band.

A box-like container is disclosed in U.S. Pat. No. 4,746,042 that is worn on a belt of a painter and can be used to hold a wet paintbrush for short periods of time. The box-like container is open at its upper end so that a paintbrush can be readily inserted into and removed from the container by the painter. Because of the open end, however, the brush can only be stored for relatively short periods of time, such as a few hours at the most. The brush cannot be stored overnight for use the next day.

In U.S. Pat. No. 4,771,501 there is disclosed a paintbrush holder that is capable of holding a solvent. The holder has a removable top, and the paintbrush is placed entirely within the container, with the bristles submerged in the solvent. The top can be closed so as to encapsulate the paintbrush entirely within the container, and the paintbrush can be stored for extended periods of time.

In U.S. Pat. No. 4,350,658 another container having a closable cover is disclosed wherein the entire paintbrush is to be received within the container. Means are provided for a liquid preservation agent to be included within the container but out of contact with the paintbrush that is contained in the container. Vapors from the liquid preservation agent contact the bristles of the wet paintbrush and maintain the wet paintbrush in a usable condition for several days.

OBJECTIVES AND BRIEF DESCRIPTION OF THE INVENTION

A principal objective of the invention is to provide a novel, rectangular-shaped container for temporary storage of a wet paintbrush, wherein the container is separable about its rectangular perimeter into two parts, with the two parts being joined by a hinge along respective sides of the two parts of the container so that the container opens in a manner of a clam shell to allow easy placement of a wet paintbrush in the container as well as removal of the paintbrush from the container.

A particular objective of the present invention is to provide a rectangular-shaped container for temporary storage of a wet paintbrush, wherein the container comprises two parts that are separable about the rectangular perimeter of the container and an opening is formed in the top walls of the two parts of the container to allow the handle of the paintbrush to pass through the opening.

A further objective of the present invention is to provide a container in accordance with the previous paragraph wherein a layer of closed cell foam material is provided along the top walls of the two parts of the container so that the closed cell foamed material is compressed around a handle of a paintbrush that passes through the opening in the container so as to substantially seal the container about the handle of the paintbrush.

A still further objective of the present invention is to provide a container in accordance with the previous two paragraphs wherein a layer of open cell foam material is provided along the bottom walls of the two parts of the container so that the open cell foam material can absorb paint drippings from the paintbrush as well as contain a relatively small amount of solvent for the paint.

The above objectives are achieved in accordance with the present invention by providing a novel, unique container that is to be used for temporarily holding and storing a wet paintbrush so as to maintain the paintbrush in a useful condition for a limited period of time up to several days. The container is a substantially rectangular in shape and comprises a shallow bottom cover member and a shallow top cover member. Each of the cover members has a substantially planar face member, with sidewalls extending generally perpendicularly from the perimeter edges of each face member. A hinge is associated with a respective, lateral sidewall of each of the cover members such that the cover members can close in a clam shell type movement toward each other so that the distal edges, that is, the otherwise free extending edges, of the sidewalls of the respective cover members abut each other to form a closed, rectangular-shaped container. The container can be opened by pivoting the cover members about the hinge so as to separate and open the container about its rectangular perimeter at the abutting edges of the sidewalls of the respective cover members. The container thus can be opened in a manner of a clam shell to allow easy placement of a wet paintbrush in the container as well as removal of the paintbrush from the container.

A cut out is formed in the distal edge of each of the sidewalls of the respective cover members that form the top wall of the container when the cover members are pivoted to their closed position. The cut outs in the abutting sidewalls register with each other to form a single opening in the top wall of the container when the cover members are pivoted to their closed position. This opening accommodates the handle of a paintbrush that is placed inside the container so that the handle extends from the container through the opening.

A layer of closed cell foamed plastic or rubber material is affixed to the inside surface of each of the top walls of the container. The layers of closed cell foamed plastic or rubber material abut each other when the top cover member and bottom cover member are pivoted to close against each other. The layers of closed cell foamed plastic or rubber material makes a compressed seal against a handle of a paintbrush that is placed in the container so that the handle extends through the opening in the top wall of the container. A layer of open cell foamed plastic or rubber material is affixed to an inside surface of the bottom walls of the container so that the layers of open cell foamed plastic or rubber material abut each other when the container is closed. The layers of open cell foamed plastic or rubber material absorb paint drippings from a paintbrush placed in the container as well as contain a relatively small amount of solvent for the paint.

Additional objects and features of the invention will become apparent from the following detailed description, taken together with the accompanying drawings.

THE DRAWINGS

Preferred embodiments of the present invention representing the best mode presently contemplated of carrying out the invention are illustrated in the accompanying drawings in which.

DETAILED DESCRIPTION OF THE ILLUSTRATED EMBODIMENT

Figure 1:
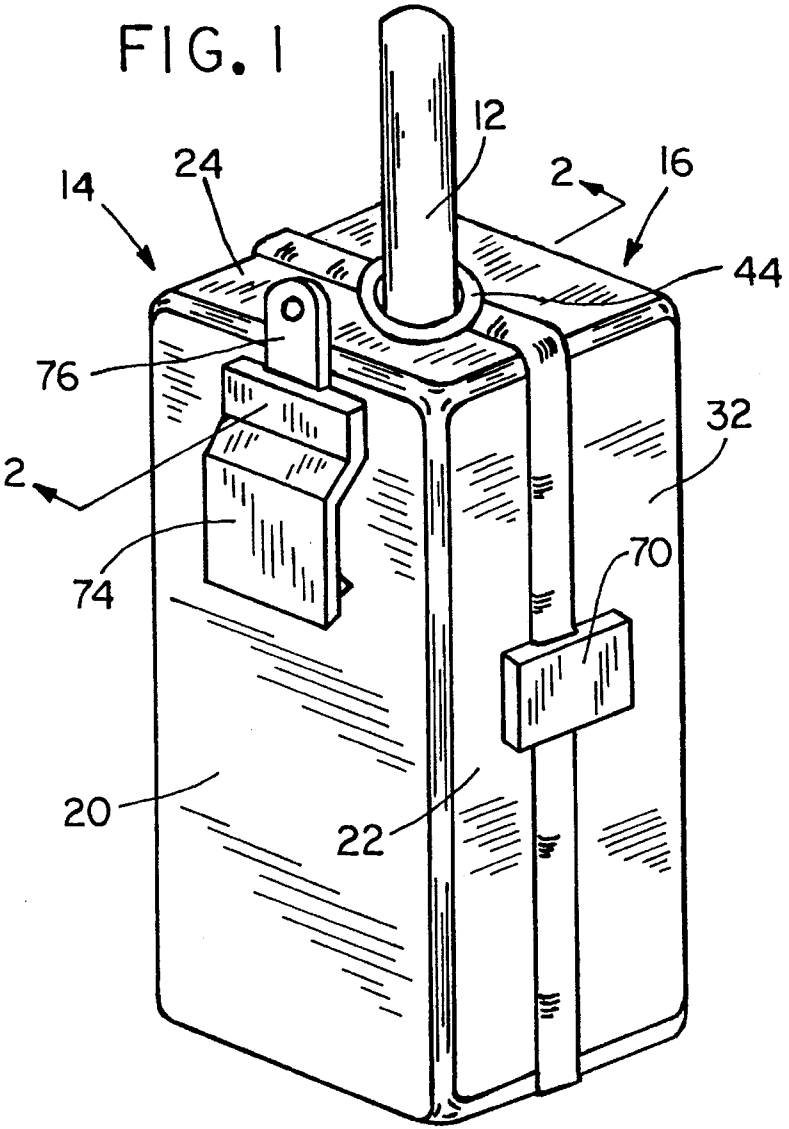
FIG. 1 is a pictorial representation of a container for temporarily holding and storing a wet paintbrush in accordance with the present invention.
Figure 2:
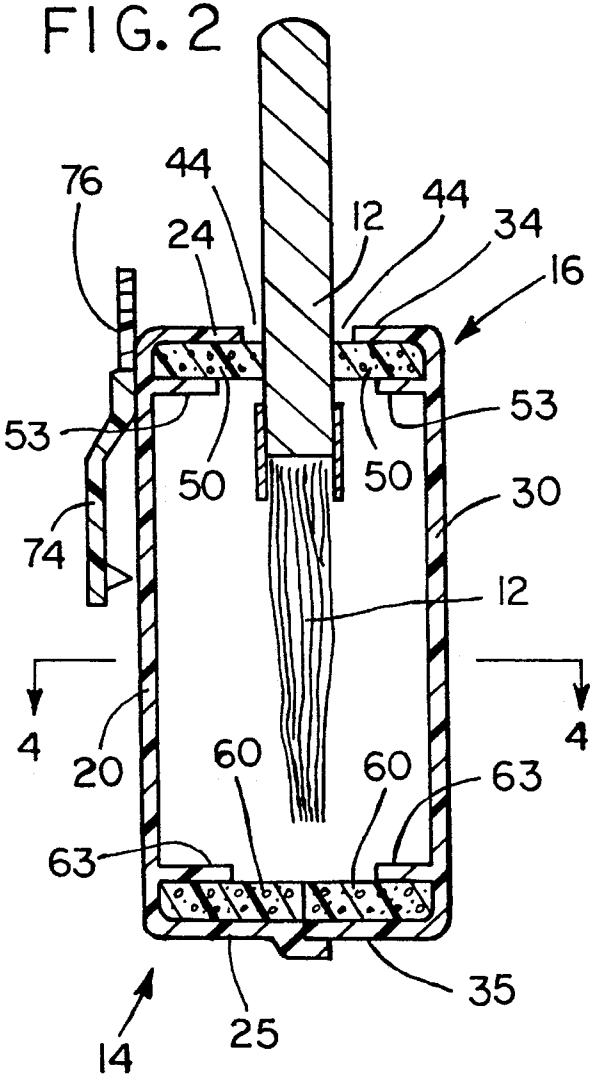
FIG. 2 is a cross section taken along line 2—2 of FIG. 1.
Figure 4:
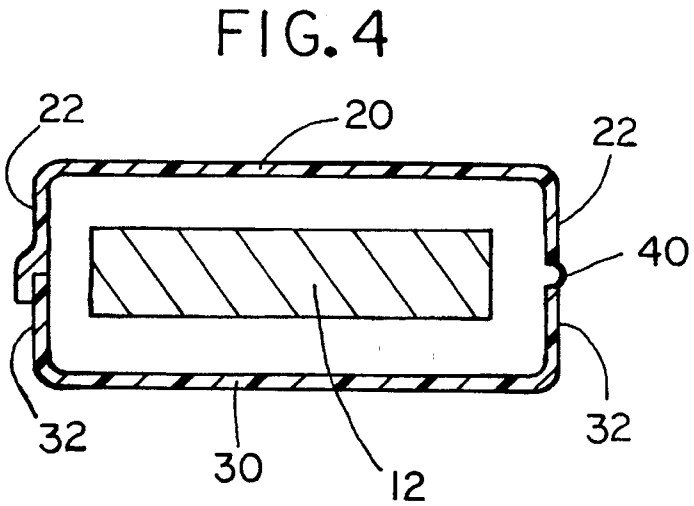
FIG. 4 is a cross section taken along line 4—4 of FIG. 2.
Figure 3:
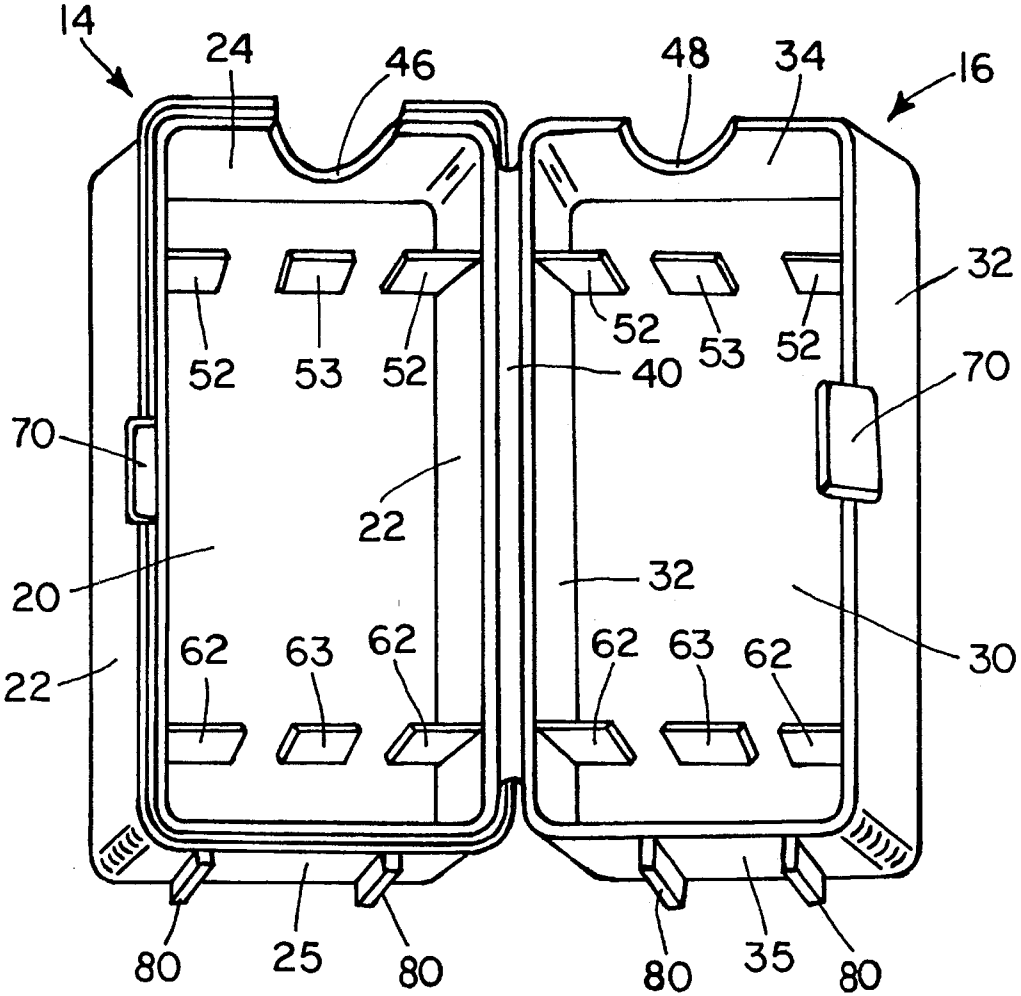
FIG. 3 is a pictorial view taken from the bottom of the container of FIG. 1 showing the container in an open position with the paintbrush removed as well as with the layers of foamed plastic or rubber material removed.

Referring now to the drawings, a container for temporarily holding and storing a wet paintbrush 12 comprises a shallow, substantially rectangular bottom cover member 14 and a shallow, substantially rectangular top cover 16. The bottom cover member has a substantially planar bottom member 20. Each of the opposite sides of the planar bottom member has a sidewall 22 extending upwardly therefrom. Opposite top and bottom sides of the planar bottom member 20 have top and bottom walls 24 and 25, respectively, extending upwardly therefrom. The otherwise free edges of the sidewalls 22 and the top and bottom walls 24 and 25, that is, the distal extending edges of the sidewalls 22 and the top and bottom walls 24 and 25 of the planar bottom member 20, lie in a common plane and form a continuous top edge of the bottom cover member 14.

The top cover member 16 has a substantially planar top member 30. Each of opposite sides of the planar top member 30 has a sidewall 32 extending downwardly therefrom. Opposite top and bottom sides of the planar top member 30 have top and bottom walls, 34 and 35, respectively, extending downwardly therefrom. The otherwise free edges of the sidewalls 32 and top and bottom walls 34 and 35, that is, the distal extending edges of the sidewalls 32 and the top and bottom walls 34 and 35 of the planar top member 30, lie in a common plane and form a continuous bottom edge of the top cover member 16.

The bottom cover member 14 and the top cover member 16 are hingedly connected to each other with a hinge 40 associated with a respective sidewall 32 of the planar top member 30 and a corresponding sidewall 22 of the planar bottom member 20. The bottom cover member 14 and the top cover member 16 can close toward each other by pivotal movement about the hinge 40 to a closed position in which the distal extending edges of the sidewalls 22 and the top and bottom walls 24 and 25 of the planar bottom member 20 abut respective, corresponding distal extending edges of the sidewalls 32 and top and bottom walls 34 and 35 of the planar top member 30. The top and bottom cover members 14 and 16 are preferably molded of a polymeric material, and the hinge 40 is advantageously a live hinge formed integrally with the corresponding sidewalls of each of the top and bottom cover members 14 and 16.

An opening 44 is cut in the top walls 24 and 34 of the planar top and bottom members 20 and 30 such that the opening 44 is substantially centered on the abutting distal extending edges of the top walls 24 and 34 of the planar top and bottom members 20 and 30 when the top and bottom cover members 14 and 16 are closed toward each other. As illustrated in the drawings, the opening 44 is formed by two cut outs 46 and 48 in the distal edges of the top walls 24 and 35, respectively. When the top and bottom cover members 14 and 16 are pivoted to the closed position, the cut outs 46 and 48 register with each other to form the opening 44. In the embodiment as illustrated, the opening 44 is oval in shape, with the long axis of the oval opening 44 coinciding with the abutting distal extending edges of the top walls 24 and 34 of the planar top and bottom members 20 and 30 when the top and bottom cover members 14 and 16 are pivoted to the closed position.

A layer 50 of closed cell foamed plastic or rubber material is affixed to an inside surface of each of the top walls 24 and 34 of the planar top and bottom members 20 and 30 such that the layers 50 of closed cell foamed plastic or rubber material abut each other when the top and bottom cover members 14 and 16 close against each other. The layers 50 of closed cell foamed plastic material can be affixed to walls of the container by an appropriate adhesive if so desired. However, it is advantageous to provide tabs 52 that project inwardly from the sidewalls 22 and 32 of the bottom and top cover members 14 and 16. A tab 53 can also project inwardly from each of the planar bottom member 20 of the bottom cover member 14 and the planar top member 30 of the top cover member 16. The tabs 52 and 53 are spaced from the respective top walls 24 and 34 of the cover members 14 and 16 to form an elongate, channel-like receptacle for receiving and holding the layers 50 of closed cell foamed plastic or rubber material. The layers 50 have a thickness so that they are held snugly within the channel-like receptacles so as to be firmly retained against the inside surface of the top walls 24 and 34 of the cover members 14 and 16.

A layer 60 of open cell foamed plastic or rubber material is affixed to an inside surface of each of the bottom walls 25 and 35 of the planar top and bottom members 20 and 30 such that the layers 60 of open cell foamed plastic or rubber material abut each other when the top and bottom cover members 14 and 16 close against each other. The layers 60 of open cell foamed plastic material can be affixed to walls of the container by an appropriate adhesive if so desired. However, it is advantageous to provide tabs 62 that project inwardly from the sidewalls 22 and 32 of the bottom and top cover members 14 and 16. A tab 63 can also project inwardly from each of the planar bottom member 20 of the bottom cover member 14 and the planar top member 30 of the top cover member 16. The tabs 62 and 63 are spaced from the respective bottom walls 25 and 35 of the cover members 14 and 16 to form an elongate, channel-like receptacle for receiving and holding the layers 60 of closed cell foamed plastic or rubber material. The layers 60 have a thickness so that they are held snugly within the channel-like receptacles so as to be firmly retained against the inside surface of the bottom walls 25 and 35 of the cover members 14 and 16.

When a wet paintbrush 12 is placed in the bottom cover member 14 and the top cover member 16 is closed against the bottom cover member 14 to enclose the wet paintbrush 12, the handle of the paintbrush 12 extends through the opening 44, and the layers 50 of closed cell foamed plastic or rubber make a compressed seal against the handle of the paintbrush. The layers 60 of open cell foamed plastic or rubber material can absorb paint drippings from the paintbrush 12 as well as contain a relatively small amount of solvent for the paint whereby the paintbrush can be maintained in usable condition for a period of time up to several days.

A catch member 70 can be associated with respective sidewalls 22 and 32 that are opposite the hinged sidewalls. The catch member 70 is adapted to releasably hold the top cover 16 and the bottom cover 14 together when the top cover member and bottom cover member are closed against each other. It is further advantageous to provide the container of the present invention with a belt clip 74 that is affixed to an exterior surface of the planar bottom member 20 of the bottom cover member 14. The belt clip 74 is positioned near the top side of the planar bottom member 20. A hang tab 76 can also extend upwardly from the side of the planar bottom member 20 of the bottom cover member 14, whereby the container can be hung from a hanger by the hang tab 76.

To aid in making a good seal when the top and bottom cover member 14 and 16 are closed, the top edge of the bottom cover member 14 and the bottom edge of the top cover member 16 have offset lips that slide snugly against each other as the top and bottom cover members 14 and 16 are closed toward each other. A pair of spaced apart feet 80 are advantageously provided on an exterior surface of each of the bottom walls 25 and 35 of the top and bottom cover members 14 and 16.

Although a preferred embodiment of a container for temporarily holding and storing a wet paintbrush of the present invention has been illustrated and described, it is to be understood that the present disclosure is made by way of example and that various other embodiments are possible without departing from the subject matter coming within the scope of the following claims, which subject matter is regarded as the invention.

I claim:

1. A container for temporarily holding and storing a wet paintbrush wherein the brush will remain in a useful condition for a limited period of time up to several days, said container comprising a shallow, substantially rectangular bottom cover member having a substantially planar bottom member, with each of opposite sides of said planar bottom member having a perimeter sidewall extending upwardly therefrom and with opposite top and bottom sides of said planar bottom member having top and bottom perimeter walls, respectively, extending upwardly therefrom, wherein distal extending edges of the sidewalls and the top and bottom walls of said planar bottom member lie in a common plane and form a continuous top edge of said bottom cover member;

a shallow, substantially rectangular top cover member having a substantially planar top member, with each of opposite sides of said planar top member having a perimeter sidewall extending downwardly therefrom and with opposite top and bottom sides of said planar top member having top and bottom perimeter walls, respectively, extending downwardly therefrom, wherein distal extending edges of the perimeter sidewalls and the top and bottom perimeter walls of said planar top member lie in a common plane and form a continuous bottom edge of said top cover member;

hinge means associated with a respective perimeter sidewall of each of said planar top and bottom members whereby said bottom cover member and said top cover member can close toward each other so that the distal extending edges of the perimeter sidewalls and the top and bottom perimeter walls of said planar bottom member abut corresponding distal extending edges of the perimeter sidewalls and top and bottom perimeter walls of said planar top member;

an opening cut in the top perimeter walls of said planar top member and said planar bottom member such that the opening is substantially centered on the abutting distal extending edges of said top perimeter walls of the planar top and bottom members when said top and bottom cover members are closed toward each other;

a layer of closed cell foamed polymeric material affixed to an inside surface of each of said top perimeter walls of said planar top and bottom members such that the layers of closed cell foamed polymeric material abut each other when the top cover member and bottom cover member close against each other;

a layer of open cell foamed polymeric material affixed to an inside surface of each of said bottom perimeter walls of said planar top and bottom members such that the layers of open cell foamed polymeric material abut each other when the top cover member and bottom cover member close against each other; and catch means associated with respective perimeter sidewalls of said planar top and bottom members that are opposite the hinged perimeter sidewalls of said planar top and bottom members wherein said catch means is adapted to releasably hold said top cover member and said bottom cover member together when the top cover member and bottom cover member are closed against each other, whereby a wet paintbrush can be placed in the bottom cover member and the top cover member then closed against the bottom cover member to enclose the wet paint brush, with a handle of the paintbrush extending through said opening and the layers of closed cell foamed polymeric material making a compressed seal against the handle of the paintbrush, and with the layers of open cell foamed polymeric material being adapted to absorb paint drippings from the paintbrush as well as contain a relatively small amount of solvent for the paint whereby the paintbrush can be maintained in usable condition for a period of time up to several days.

2. A container for holding and storing a wet paintbrush in accordance with claim 1 wherein a belt clip is affixed to an exterior surface of the planar bottom member of said bottom cover member, with said belt clip being positioned near the top side of said planar bottom member.

3. A container for holding and storing a wet paintbrush in accordance with claim 1, wherein a hang tab extends upwardly from a side of said planar bottom member of said bottom cover member, whereby the container can be hung from a hanger by the hang tab.

4. A container for holding and storing a wet paintbrush in accordance with claim 1 wherein said opening is oval in shape with a long axis of the oval-shaped opening coinciding with the abutting distal extending edges of the top perimeter walls of said planar top and bottom members when said top and bottom cover members are closed toward each other.

5. A container for holding and storing a wet paintbrush in accordance with claim 1 wherein said top edge of said bottom cover member and said bottom edge of said top cover member have offset lips that slide snugly against each other as said top and bottom cover members are closed toward each other.

6. A container for holding and storing a wet paintbrush in accordance with claim 1 wherein said hinge means is a live hinge formed integrally with corresponding sidewalls of each of said planar top member and said planer bottom member.

7. A container for holding and storing a wet paintbrush in accordance with claim 1 wherein a pair of spaced apart feet are provided on an exterior surface of each of the bottom walls of said top and bottom cover members.

* * * * *